US005964488A

United States Patent [19]

Bedel

[11] Patent Number: 5,964,488

[45] Date of Patent: Oct. 12, 1999

[54] FOLDABLE DEVICE FOR MANUALLY PICKING UP SAMPLES OR SUBSTANCES

[76] Inventor: Jaime Rafael Bedel, Santago del Estero 1148, (1057) Buenos Aires, Argentina

[21] Appl. No.: 09/000,867

[22] Filed: Dec. 30, 1997

[51] Int. Cl.[6] ..... A01K 29/00; E01H 1/12

[52] U.S. Cl. ..... 294/1.3; 294/25; 15/257.6; 229/117.12

[58] Field of Search ..... 294/1.3–1.5, 25, 294/55; 15/257.1, 257.6; 229/117.01, 117.03, 117.09, 117.12

[56] References Cited

U.S. PATENT DOCUMENTS

| | | | |
|---|---|---|---|
| 3,685,088 | 8/1972 | Doherty | 294/1.3 |
| 3,971,503 | 7/1976 | Allan et al. | 294/1.3 |
| 4,747,633 | 5/1988 | Stacy | 294/1.3 |
| 5,540,333 | 7/1996 | Gonzalez et al. | 294/55 |

FOREIGN PATENT DOCUMENTS

| | | | |
|---|---|---|---|
| 3909-418 | 11/1989 | Germany | 294/1.3 |
| 4013-479 | 1/1991 | Germany | 294/1.3 |

*Primary Examiner*—Dean Kramer
*Attorney, Agent, or Firm*—Finnegan, Henderson, Farabow, Garrett & Dunner, L.L.P.

[57] ABSTRACT

A foldable device for manually picking up samples or substances, which may or may not be foul-smelling, and, more particularly, domestic animal feces. The device is formed by a laminar element including a rectangular principal body having three fold lines or creases perpendicular to its longer sides, a first of the fold lines or creases being in substantially the central region of the rectangle and the other two being close to its shorter sides, thereby to define substantially rectangular end tabs on the body. Substantially triangular lugs are joined to the longer sides of the rectangle, each triangular lug being divided into two triangular parts by a crease originating at the vertex of each lug, the latter coinciding with the end of the central crease of the rectangular body. Each of the triangular parts have, joined to their bases by a crease, substantially trapezoidal individual flanges, the substantially trapezoidal tab, the substantially rectangular tab and the external triangular parts having fastening or joining flaps.

6 Claims, 3 Drawing Sheets

FOLDABLE DEVICE FOR MANUALLY PICKING UP SAMPLES OR SUBSTANCES

Figure 1:
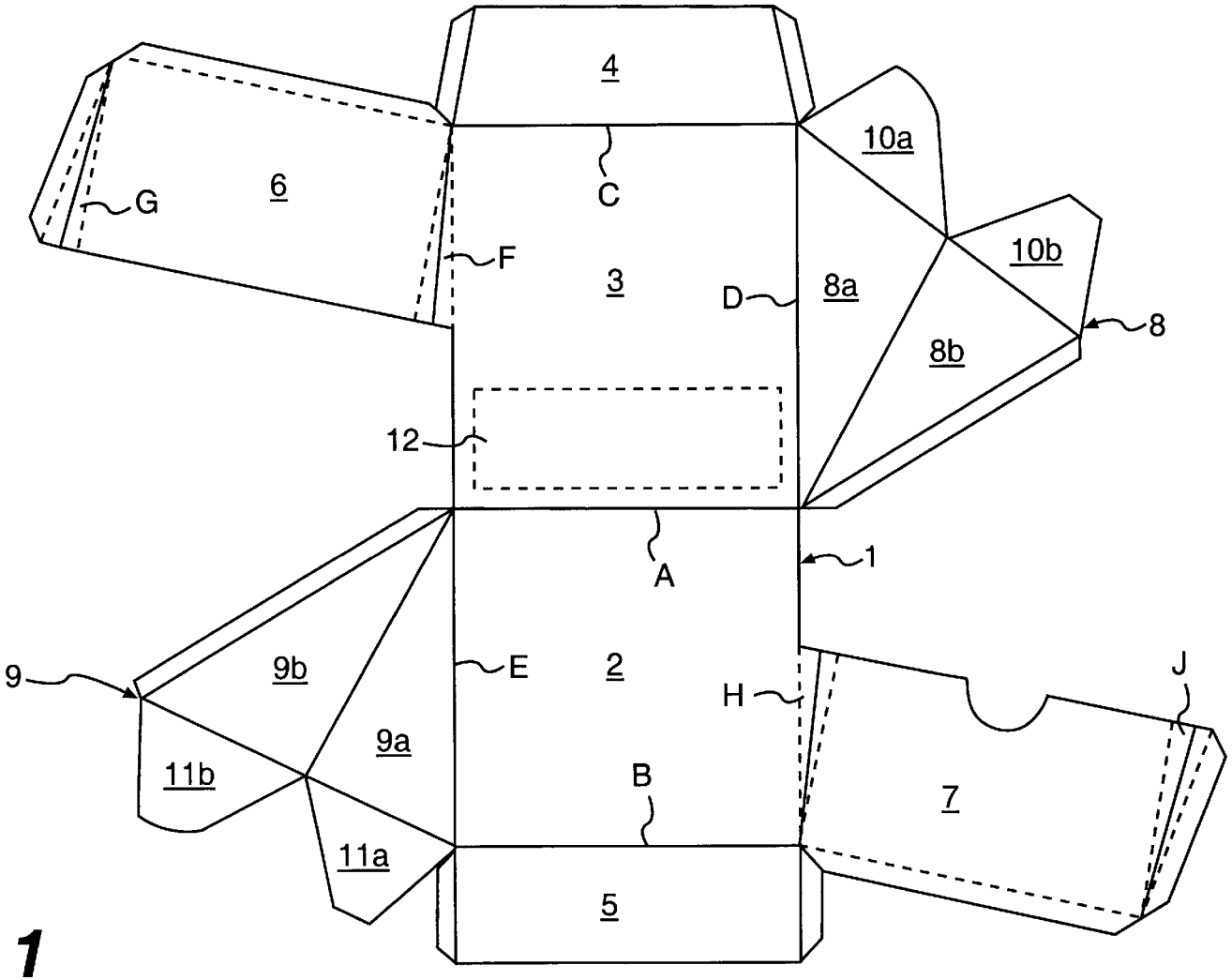

The present invention relates to a foldable device which is suitable for manually picking up samples or substances, which may or may not be foul-smelling, and, more particularly, to a foldable device for picking up domestic animal feces.

Everyone is aware of the problem posed by the feces of domestic cats and dogs when these are deposited on the public thoroughfare and which obliges their owners to use a scoop and a bag to pick the feces up and to dispose of them later in a suitable place. Many owners of pets or domestic animals are also known to be reluctant to walk along the streets with the abovementioned scoop and bag, which means that the waste frequently remains in the streets and on the sidewalks, with the risk this involves for passersby or pedestrians.

It is therefore the object of the present invention to solve this problem by providing a foldable device which may be carried in a pocket or in a purse and which is suitable for picking up domestic animal feces, without soiling one's hands.

A further object of the present invention is to provide a foldable device, which may be reused, for picking up samples or substances, or which may be thrown away, i.e. which is disposed of after use.

It is obvious that the invented device also serves for picking up samples, for example, of pulverulent or granular materials, in a hygienic manner and that it enables said samples to be transported to the place where they are deposited or kept. In an alternative embodiment the invented device may remain closed after the samples or feces have been collected.

The subject of the present invention is therefore a foldable device which is suitable for picking up samples or substances, which, in its folded-up position, may be kept in a pocket or in a purse, and which is formed by a laminar element which consists of a rectangular principal body which has two fold lines or creases perpendicular to its longer sides, one of said fold lines or creases being made in the substantially central region of said rectangle and the other being made close to one of its shorter sides, determining a substantially rectangular tab, a substantially trapezoidal tab, whose major base coincides with said other, shorter side of said rectangle, being joined to the other, opposite shorter side, and substantially triangular individual lugs being joined to the longer sides of said rectangle, each triangular lug being divided into two triangular parts by a crease which originates at the vertex which coincides with the end of the central crease of the rectangular body, each one of said triangular parts having, joined to their bases by means of a crease, substantially trapezoidal individual flanges, said substantially trapezoidal tab, said substantially rectangular tab and the external triangular parts having fastening or joining flaps.

Throughout this specification and the claims, the terms "fold lines" and "creases" are used to indicate the same thing.

In an alternative embodiment the subject of the present invention the rectangular principal body has on its longer edges, substantially trapezoidal individual projections which include three creases on their shorter sides and two fastening flaps each. Once the device of the invention has been made up, said projections form pockets or handles in which the user's fingers are inserted in order to operate said device. It is obvious that such pockets may be replaced by an elastic band or by a strip of laminar material, or something similar.

The invention will be better understood with reference to the appended drawings which show a preferred embodiment of the proposed article.

Figure 2A:
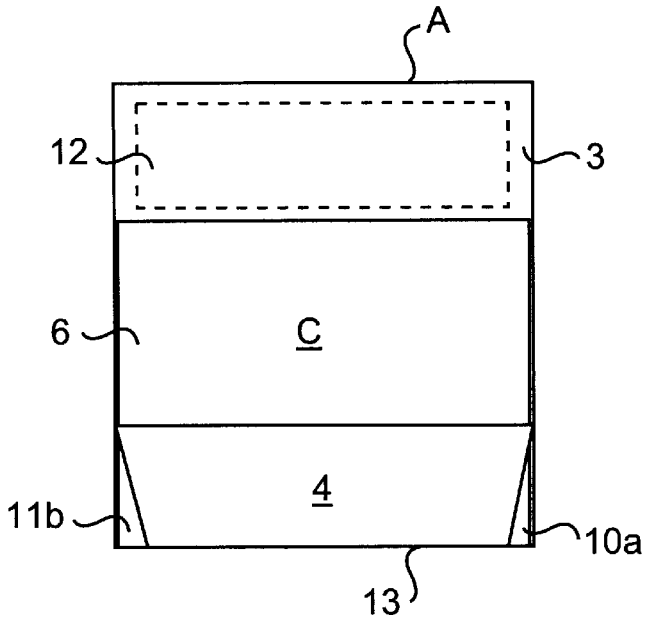
Figure 2B:
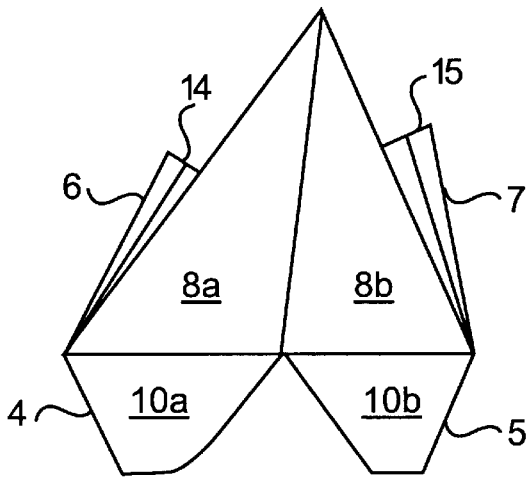
Figure 3A:
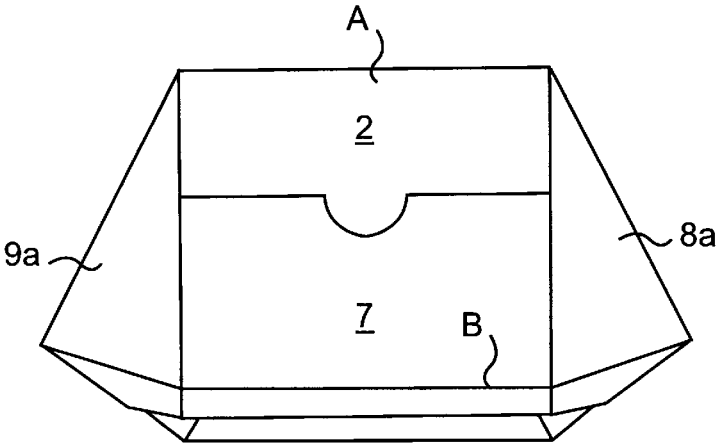
Figure 3B:
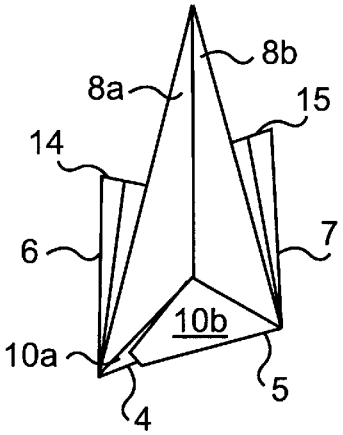
Figure 4A:
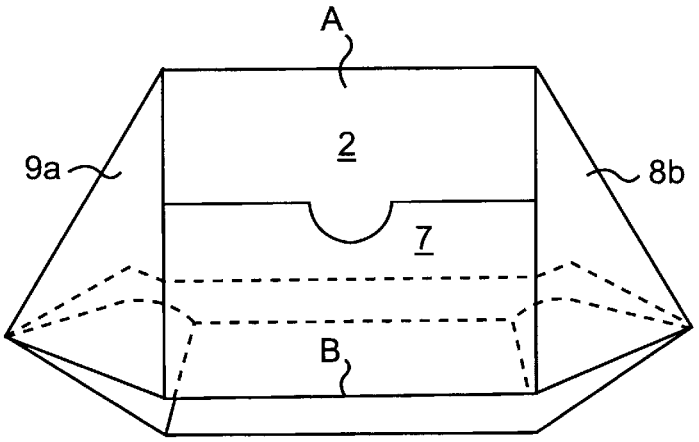
Figure 4B:
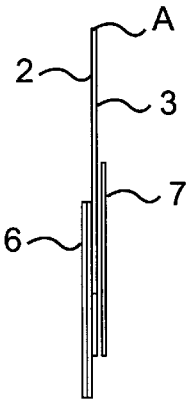

In the drawings:

FIG. 1 shows an unfolded version of the template to be used for making the invented article;

FIGS. 2*a* and 2*b* show the foldable device from the front and from the side in its open position;

FIGS. 3*a* and 3*b* show the foldable device from the front and from the side in its closed position, i.e. after a sample has been collected; and FIGS. 4*a* and 4*b* show the foldable device from the front and from the side in its folded-up position.

FIG. 1 therefore shows a sheet of a laminar material, for example cardboard, paper, plastic, card, laminated metal, etc., which consists of a rectangular principal body 1 which has a crease A substantially in the central region of said principal body 1 and a crease B close to one of the smaller sides of said rectangle, both creases A and B being perpendicular to the larger sides of said rectangle and the crease B delimiting a substantially rectangular tab 5, and a substantially trapezoidal tab 4 being joined said principal body 1 on its other smaller or shorter side by means of a crease C which coincides with said shorter side of the principal body 1.

The two tabs 4 and 5 have, on their shorter sides, small wings for fastening or joining, by means of some suitable means, such as, for example, an adhesive, to substantially trapezoidal flanges 10*a*, 10*b*, 11*a* and 11*b*, which are described below.

The principal body 1 has, in addition, two triangular lugs 8 and 9 joined to the longer sides of the rectangle of the body 1 by means of the creases D and E, and with their vertices arranged at the ends of the crease A.

Each triangular lug 8 and 9 is divided into two triangular parts 8*a* and 8*b* and 9*a* and 9*b*, respectively, the external parts 8*b* and 9*b* having small wings for joining or fastening them, by means of some suitable means, to the principal body 1. These suitable means may, depending on the material chosen for constructing the device, be adhesives, rivets, clips, staples etc.

Each of said triangular parts 8*a*, 8*b*, 9*a* and 9*b* has, joined on its base, one of said substantially trapezoidal flanges 10*a*, 10*b*, 11*a* and 11*b* mentioned.

Once the foldable device has been made up, the flanges 10*a*, 10*b*, 11*a* and 11*b* and the tabs 4 and 5 form the mouth or entrance for the samples or feces.

FIG. 1 also shows two substantially trapezoidal projections 6 and 7 which, on each of their shorter sides, have three creases F, G, H and J, forming individual bellows, and two small flaps for joining or fastening said projections 6 and 7 to the principal body 1. These projections, once adhesively bonded to the body, form two pockets in which the user's fingers are inserted in order to prevent the device of the invention slipping while it is being used. Clearly, these pockets may be replaced by other elements, such as, for example, two strips of cardboard, or two rubber bands, or something similar.

Once made up, the foldable device which is the subject of the invention adopts the form shown in FIGS. 2*a* and 2*b*, in which the mouth or entrance 13 via which the samples or feces are collected and the entrances 14 and 15 of the pockets formed by the projections 6 and 7 may be seen. It is understood that only one or both projections may be present.

FIGS. 3*a* and 3*b* show the foldable device of the invention in its closed position, i.e. after the samples or feces have been collected, and in them it may be seen that the entrance

13 is closed because the tabs 4 and 5 and also the flanges 10*a* and 10*b* (and 11*a* and 11*b*, not shown in these figures) are mounted on one another. In this position it is possible to transfer the substances collected to the place where they will be deposited or kept.

FIGS. 4*a* and 4*b* show, diagrammatically, how, by inverting the crease at the joints between the flanges and the tabs and the principal body, it is possible to fold up the device of the invention until it is practically flat. The projections 6 and 7 are attached to the principal body by virtue of the bellows-shaped creases.

The device of the invention may have, suitably adhesively bonded to its inside, a double-sided adhesive tape 12 which will keep it closed after the domestic animal feces or waste has been collected.

It is also obvious that the free edges of the tabs 4 and 5 may be indented or corrugated, or of diverse shapes, and that the surfaces thereof may have perforations, and that the device may be constructed from any laminar material such as cardboard, plastic, textile materials, cards, laminated metal, aluminum etc.

I claim:

1. A foldable laminar element device for picking up samples or substances, and capable of being kept in a pocket or in a purse in a folded condition, comprising:

a rectangular principal body having long and short sides and including three fold lines perpendicular to the long sides, a first of the three fold lines being located substantially in a central region of the principal body, a second of the three fold lines being located at one of the short sides and defining a first tab, a third of the three fold lines located at the other of the short sides and defining a second tab, and a pair of substantially triangular lugs joined to the long sides of said rectangle at lug edge fold lines and each having a vertex at the first of the three fold lines, each triangular lug being divided into two triangular parts by a central lug fold line extending from the vertex thereof, each of said triangular parts having a base and a substantially trapezoidal flange joined to the base by a base fold line, said substantially trapezoidal tabs, said first and second tabs and said triangular lugs having fastening flaps.

2. The foldable laminar element device of claim 1, further including at least one substantially trapezoidal projection joined to said principal body by bellows defining folds, thereby forming at least one pocket for receiving a user's fingers.

3. The foldable laminar element device of either of claims 1 or 2, wherein said device is constructed from cardboard, plastic, laminated metal, or aluminum.

4. The foldable laminar element device of claim 1, further including a double-sided adhesive tape for keeping said device in a closed condition.

5. The foldable laminar element device of claim 1, wherein said tabs have indented edges.

6. The foldable laminar element device of claim 1, wherein one of the first and second tabs is trapezoidal and has a base at one of the second and third of the three fold lines.

* * * * *